US005415326A

United States Patent [19]

Durham et al.

[11] Patent Number: 5,415,326

[45] Date of Patent: May 16, 1995

[54] LARGE VOLUME BEVERAGE DISPENSING NOZZLE

[75] Inventors: Samuel Durham; Weldon E. Griffin; David A. Renaud, all of San Antonio, Tex.

[73] Assignee: Lancer Corporation, San Antonio, Tex.

[21] Appl. No.: 198,226

[22] Filed: Feb. 17, 1994

[51] Int. Cl.[6] ..... B67D 5/56

[52] U.S. Cl. ..... 222/129.1; 222/145.5; 239/419.3

[58] Field of Search ..... 222/129.1–129.4, 222/145, 459; 239/419, 419.3, 424, 427.3, 590.3

[56] References Cited

U.S. PATENT DOCUMENTS

| | | | |
|---|---|---|---|
| 4,509,690 | 4/1985 | Austin et al. | 239/429 |
| 4,928,854 | 5/1990 | McCann et al. | 222/129 |
| 4,986,447 | 1/1991 | McCann et al. | 222/129.1 |
| 5,048,726 | 9/1991 | McCann et al. | 221/120 |
| 5,186,363 | 2/1993 | Haynes | 222/129.1 X |
| 5,203,474 | 4/1993 | Haynes | 222/129.1 |

*Primary Examiner*—Andres Kashnikow
*Assistant Examiner*—Kenneth R. DeRosa
*Attorney, Agent, or Firm*—Donald R. Comuzzi; Christopher L. Makay

[57] ABSTRACT

A beverage dispensing nozzle which dispenses beverages at a high volume flow comprises a housing which includes a body and cap having an opening therein connected to the top of the body, a conduit in the lower portion of the body, a diffuser residing over the conduit, and a diffuser plate positioned about the diffuser. The nozzle connects to a standard electric valve which communicates with both a beverage syrup source and a mixing fluid source. The diffuser includes a passageway which communicates with the beverage syrup source to deliver beverage syrup into a mixing chamber defined by the interior of the conduit. The exterior surface of the diffuser and the interior surfaces of the body and cap define a first channel which communicates with the mixing fluid source. The exterior surface of the conduit and the interior surface of the body define a second channel. The diffuser plate resides within the first channel and includes a plurality of holes that produce a laminar flow in the mixing fluid stream as it enters the first channel. Upon exit from the first channel, the conduit divides the mixing fluid stream into a first and second mixing fluid streams. The first mixing fluid stream enters the mixing chamber where it mixes with the beverage syrup before being dispensing from an outlet of the housing. The second mixing fluid stream flows through the second channel and exits the second channel at the outlet of the housing where it contacts the previously mixed beverage syrup and mixing fluid stream flowing from the mixing chamber. The second mixing fluid stream and the previously mixed beverage syrup and mixing fluid combine in a cup to form a dispensed beverage.

5 Claims, 2 Drawing Sheets

LARGE VOLUME BEVERAGE DISPENSING NOZZLE

BACKGROUND OF THE INVENTION

1. Field of the Invention

The present invention relates to beverage dispensing apparatus and, more particularly, but not by way of limitation, to a beverage dispensing nozzle that dispenses drinks at a high flow rate to increase the volume of drinks dispensed in a given time period.

2. Description of the Related Art

Due to increases in both the number of customers served and the volume of the drinks dispensed by the food and drink service industry, standard drink dispensing nozzles fail to meet customer demand. Standard dispensing nozzles dispense carbonated beverages at a flow rate of between 1½ to 3 ounces per second. However, flow rates below 3 ounces per second are totally inefficient when filling large volume cups (e.g., 32 ounces or more). Standard beverage dispensing nozzles simply do not dispense beverages fast enough to satisfy customer demand in beverage dispensing establishments that serve large numbers of customers.

Furthermore, the flow rates of standard dispensing nozzles cannot be increased above their maximum of 3 ounces per second because excessive foaming in the carbonated beverage occurs. To prevent excessive foaming, the carbonated water which enters the nozzle at a high pressure must be gently reduced to atmospheric pressure so that a minimum of carbon dioxide will escape solution. At flow rates above 3 ounces per second, standard dispensing nozzles are incapable of gradually reducing the pressure of the carbonated water which results in an excessive out-gassing of carbon dioxide. Consequently, as the carbonated water releases carbon dioxide in both the nozzle and the cup, the released carbon dioxide escaping solution causes excessive foaming of the dispensed beverage. That excessive foaming creates a poor product because the drink is generally "flat".

Additionally, merely increasing the size of the flow path in standard dispensing nozzles will not permit increased flow rates because standard nozzles do not provide proper mixing between the carbonated water and beverage syrup under high flow rates. At high flow rates the lack of proper mixing within standard nozzles creates stratification between the beverage syrup and carbonated water within the cup, thereby, producing a poor tasting drink.

Related U.S. Pat. Nos. 4,928,854; 4,986,447; and 5,048,726, issued on May 29, 1990; Jan. 22, 1991; and Sep. 17, 1991, respectively, to McCann disclose diffuser and spout assemblies which provide increased flow rates over standard nozzles. McCann, et al. disclose a body having a plurality of diffuser elements disposed therein and a flow separator connected to its lower portion. A spout connects to the body to provide an outlet for the beverage. The body includes a syrup inlet which communicates with the mixing chamber of the spout and a pair of inlets which communicate with the diffuser elements.

Each diffuser element comprises a series of interconnected plates which reduce the pressure of the carbonated water as it flows through the plurality of holes within each plate. After contacting the diffuser elements, the carbonated water exits the body where the flow separator divides the carbonated water stream into one stream which is directed into the mixing chamber of the spout and a second stream which flows around the outside of the spout. As the carbonated water stream enters the mixing chamber, it mixes with syrup and then exits the spout with the syrup into a cup below. The stream traveling around the spout contacts the carbonated water and syrup stream exiting the mixing chamber to provide additional mixing.

Although the diffuser elements within the body function adequately to reduce the pressure of the carbonated water, thereby decreasing foaming within the cup, the McCann, et al. diffuser and spout assembly suffers from design disadvantages. That is, the assembly is unsanitary due to its difficulty in cleaning and its exposed parts which collect dirt, bacteria, and germs. The body does not separate into easily accessible parts which allow individual cleaning, rather, a cleaning solution must be run through the body and spout. Thus, whenever the assembly is cleaned a less than satisfactory disinfecting results.

Furthermore, because the outside of the spout is exposed, it provides an easily accessible location for the accumulation of dirt, bacteria, and germs through contact with the atmosphere or human contact during the filling of drinks. Consequently, as the carbonated water of the second stream flows about the outside of the spout, it picks up dirt, bacteria, and germs that have accumulated on the exposed surface of the spout.

Accordingly, a beverage dispensing nozzle that is a self-contained unit with no exposed parts which disassembles into easily cleanable parts while still dispensing beverages in a high volume flow is highly desirable.

SUMMARY OF THE INVENTION

In accordance with the present invention, a nozzle for dispensing beverages in a high volume flow comprises a housing, a conduit positioned in the lower portion of the housing, a diffuser residing over the conduit, and a diffuser plate placed about the diffuser. The housing comprises a body connected at its upper portion to a cap having an opening therein. The cap provides the connection point between the nozzle and any standard electric valve. Additionally, the neck of the diffuser protrudes from the opening through the cap to allow its insertion into the standard electric valve.

The diffuser includes a passageway through its interior which allows the diffuser to communicate with a beverage syrup source connected to the standard electric valve. Furthermore, the outer surface of the diffuser and the inner surfaces of the body and cap form a first channel which communicates with a mixing fluid source connected to the standard electric valve. The conduit resides within the lower portion of the body such that its interior forms a mixing chamber and its exterior surface and the interior surface of the body form a second channel. Both the mixing chamber and the second channel exit the nozzle from an outlet in the bottom of the body.

Upon the activation of the standard electric valve, beverage syrup flows from the beverage syrup source through the standard electric valve and into the passageway within the diffuser. From the passageway in the diffuser, the beverage syrup flows into the mixing chamber via a plurality of outlets in the diffuser. Additionally, mixing fluid flows from the mixing fluid source through the standard electric valve and into the first channel. First, however, the mixing fluid flows through the diffuser plate which includes a plurality of holes to create a laminar flow in the mixing fluid as it enter the first channel.

The mixing fluid exits the first channel and contacts the conduit which divides the mixing fluid into a first and second stream. The first mixing fluid stream enters the mixing fluid chamber where it mixes with the beverage syrup before exiting the nozzle. The second mixing fluid stream flows through the second channel and then exits the nozzle. The mixing fluid exiting the second channel contacts the mixed beverage syrup and mixing fluid exiting the mixing chamber so that both streams enter a cup below the nozzle to produce a final mixing which forms the dispensed beverage drink.

It is, therefore, an object of the present invention to provide a beverage dispensing nozzle that dispenses a beverage syrup and mixing fluid at a high volume flow to form a dispensed beverage drink.

It is another object of the present invention to provide a beverage dispensing nozzle that eliminates stratification between the beverage syrup and mixing fluid.

It is a further object of the present invention to provide a beverage dispensing nozzle that is configured to decelerate and decrease the pressure of the incoming mixing fluid to approximately 0 psig to prevent the excessive escape of gas placed into solution in the mixing fluid.

Still other objects, features, and advantages of the present invention will become apparent to those skilled in the art in light of the following.

DETAILED DESCRIPTION OF THE PREFERRED EMBODIMENT

Figure 1:
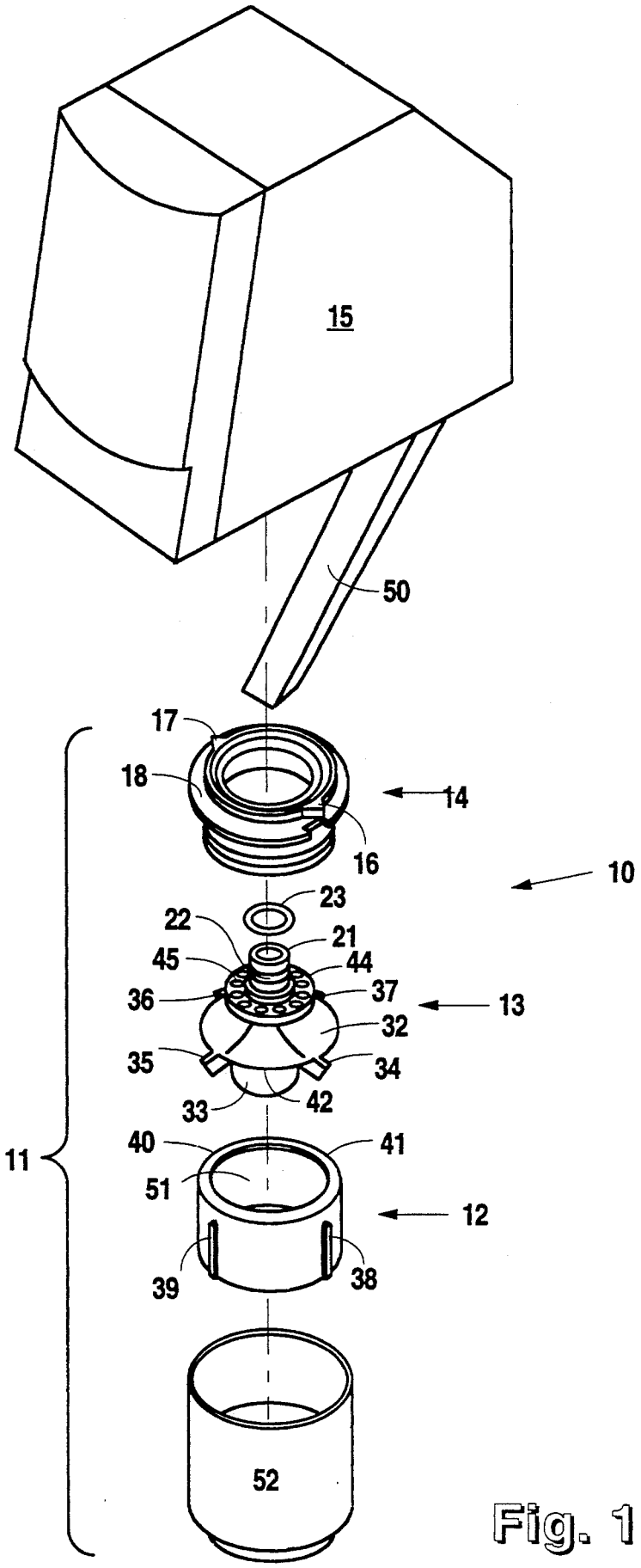
FIG. 1 is an exploded view in perspective depicting the beverage dispensing nozzle of the present invention.
Figure 2:
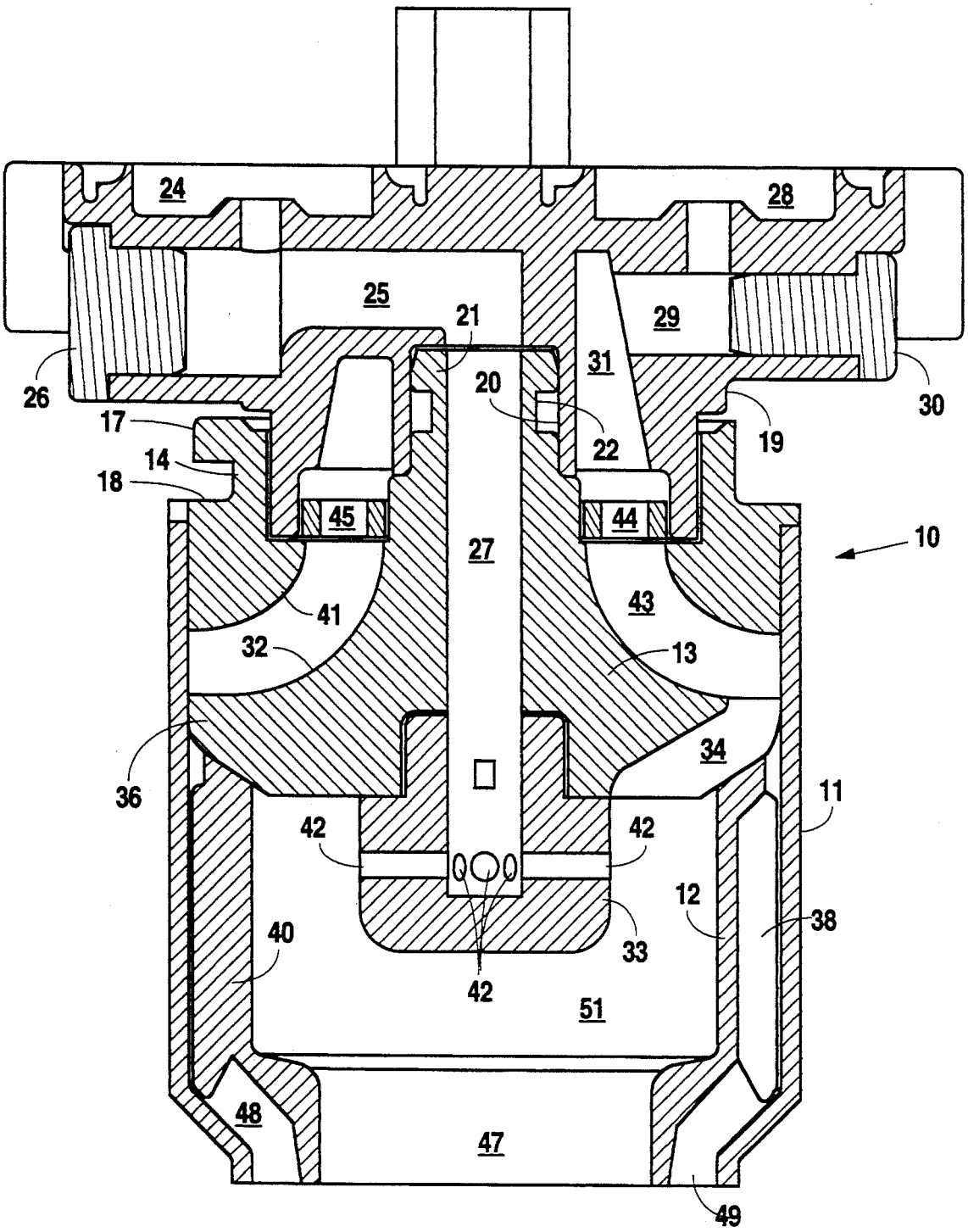
FIG. 2 is a cross-section taken along lines 2,2 of FIG. 1 depicting the beverage dispensing nozzle of the present invention.

As illustrated in FIGS. 1 and 2, beverage dispensing nozzle 10 comprises housing 11 which includes body 52 and cap 14, conduit 12, diffuser 13, and diffuser plate 44. Conduit 12 resides in the lower portion of body 52 with diffuser 13 positioned over top. Diffuser plate 44 resides on diffuser 13, while cap 14 threadably connects to body 52 to form housing 11. Although cap 14 has been described as threadably connected to body 52, it is understood that it could be permanently affixed to form an integral one piece unit.

The interior surface of conduit 12 defines mixing chamber 51 within body 52. The exterior surface of conduit 12 includes vanes 38–41 which reside against the inner surface of the lower portion of body 52 to form circular channel 48 between the exterior surface of conduit 12 and the inner surface body 52.

Diffuser 13 comprises neck 21, body 32, and head 33 formed integrally as one piece using any standard plastic molding process. Neck 21, body 32, and head 33 include passageway 27 therein which receives beverage syrup from a beverage syrup source (described herein). Head 33 includes a plurality of outlets 42 (8 in this preferred embodiment) which communicate beverage syrup from passageway 27 into mixing chamber 51. The exterior surface of body 32, the interior surface of body 52, and the curved interior surface of cap 14 form circular channel 43 which receives mixing fluid from a mixing fluid source (described herein). Additionally, diffuser 13 includes fins 34–37 which separate body 32 of diffuser 13 from conduit 12 to permit the mixing fluid to flow from passageway 43 into mixing chamber 51 and channel 48.

Diffuser plate 44 comprises a circular disk having an opening in its center which allows it to reside on the lip formed at the connection point between body 32 and neck 21. Diffuser plate 44 includes a plurality of holes 45 which permit the mixing fluid to flow through diffuser plate 44 into channel 43.

Cap 14 includes an opening therethrough which permits neck 21 of diffuser 13 to protrude. Thus, cap 14 and neck 21 of diffuser 13 connect to dispensing valve 15 to allow the dispensing of beverages through nozzle 10. Dispensing valve 15 may be any electric dispensing valve suitable to deliver a mixing fluid and a beverage syrup to nozzle 10. Cap 14 includes tabs 16 and 17 and lip 18 which permit the connection of nozzle 10 to dispensing valve 15. The underside of dispensing valve 15 includes an opening (not shown) which permits lower unit 19 (see FIG. 2) to protrude. The edges of the opening include a pair of slots (not shown) adapted to receive tabs 15 and 16. Additionally, lower unit 19 includes cavity 20 (see FIG. 2) which is adapted to receive neck 21 of diffuser 13. Neck 21 includes groove 22 which receives O-ring 23 to form a fluid seal between neck 21 and cavity 20.

Thus, to connect nozzle 10 to dispensing valve 15, neck 21 is inserted into cavity 20 until it resides completely therein. After inserting neck 21 into cavity 20, tabs 16 and 17 are inserted through their corresponding slot, and then nozzle 10 is rotated such that tabs 15 and 16 catch the inner surface along the edges of the opening in the underside of dispensing valve 15. With tabs 15 and 16 inserted within dispensing valve 15, lip 18 abuts the outer surface along the edges of the opening in the underside of dispensing valve 13. Accordingly, once nozzle 10 has been connected to the underside of dispensing valve 15, lower unit 19 can communicate both beverage syrup and mixing fluid into nozzle 10.

Lower unit 19 of dispensing valve 15 connects at inlet 24 to a beverage syrup source (not shown) using any suitable syrup conduit. A pump (not shown) suitable for pumping beverage syrups resides between the beverage syrup source and inlet 24 to pump the beverage syrup through inlet 24 into channel 25. Channel 25 includes plug 26 which prevents leakage of beverage syrup from channel 25. Channel 25 connects to cavity 20 to deliver the beverage syrup into passageway 27 of diffuser 13.

Lower unit 19 further includes inlet 28 which connects to a mixing fluid source, typically a carbonator, using any suitable conduit. A pump (not shown) suitable for pumping the mixing fluid (carbonated water in this preferred embodiment) resides between the mixing fluid source and inlet 28 to pump mixing fluid through inlet 28 into channel 29. Channel 29 includes plug 30 which prevents the leakage of the mixing fluid from channel 29. Channel 29 connects to cavity 31 which is a circular cavity formed within lower unit 19 about the outer wall of cavity 20.

Cavity 31 communicates the mixing fluid into channel 43 via the holes 45 within diffuser plate 44. From channel 43, the mixing fluid flows around body 32 where it is divided into two streams by conduit 12. A first stream flows into mixing chamber 51 where it mixes with the beverage syrup delivered into mixing chamber 51 from passageway 27 of diffuser 13 via the outlets 42 from head 33. After mixing, the mixing fluid and beverage syrup are delivered from mixing chamber 51 through outlet 47 which is defined at the outlet of body 52 by conduit 12. The second stream flows around conduit 12 into channel 48 where it exits channel 48 via outlet 49 which is defined at the outlet from body 52 by conduit 12. As the second mixing fluid stream exits channel 48, it contacts the previously mixed beverage syrup and mixing fluid. The previously mixed beverage syrup and mixing fluid combines with the second stream of mixing fluid in a cup below nozzle 10 where a final mix occurs to produce a dispensed beverage.

More specifically, when a person desiring a drink presses lever 50, lever 50 activates switches which permit the delivery of power to the beverage syrup and mixing fluid pumps. Consequently, those pumps activate to deliver beverage syrup into channel 25 and mixing fluid into channel 29, respectively. The beverage syrup flows from channel 25 into passageway 27 of diffuser 13 where it exits diffuser 13 into mixing chamber 51 via outlets 42 of head 33.

The mixing fluid enters channel 29 in a relatively turbulent flow due to its delivery under high pressure. Illustratively, if the mixing fluid is carbonated water, it enters channel 29 at a pressure of at least 100 psi. Thus, in order for nozzle 10 to provide adequate mixing between the mixing fluid and beverage syrup to prevent stratification and, in the case of carbonated water, to prevent release of excessive amounts of $CO_2$ gas, nozzle 10 must decelerate the flow rate and reduce the pressure of the incoming mixing fluid. As the mixing fluid enters cavity 31, an initial deceleration and decrease in pressure occurs due to the difference in volume between channel 29 and cavity 31. That is, cavity 31 provides the mixing fluid with a greater volume which results in a corresponding decrease in both flow rate and pressure as the mixing fluid expands into the greater volume.

The mixing fluid then flows from cavity 31 into channel 43 via diffuser plate 44. As the mixing fluid flows through the holes 45 of diffuser plate 44, the holes 45 create a laminar flow in the mixing fluid stream entering channel 43. The creation of the laminar flow prevents the out-gassing of $CO_2$ through the reduction of the initial turbulence in the incoming stream of mixing fluid. Additionally, the increase in volume between cavity 31 and channel 43 again decreases the pressure.

The mixing fluid stream flows through channel 43 where it contacts the top conduit 12. Conduit 12 divides the single mixing fluid stream into a first mixing fluid stream which enters mixing chamber 51 and a second mixing fluid stream which enters channel 48. As the first mixing fluid stream enters mixing chamber 51, it again decelerates and decreases pressure due to the increased volume within mixing chamber 51. Furthermore, the first mixing fluid stream mixes with the beverage syrup entering mixing chamber 51 from outlets 42 in head 33 of diffuser 13. The mixing fluid and beverage syrup mix within mixing chamber 51 and then flow from mixing chamber 51 out outlet 47. By the time the mixing fluid and beverage syrup mix within mixing chamber 51 and flow from outlet 47, the pressure of the combined mixing fluid and beverage syrup is approximately 0 psig.

As the second mixing fluid stream enters channel 48, it also decelerates and decreases in pressure. The second mixing fluid stream flows from channel 48 via outlet 49 where it contacts the stream of previously mixed mixing fluid and beverage syrup exiting outlet 47. Similar to the premixed stream, the second fluid stream exits channel 48 at approximately 0 psig. The previously mixed beverage syrup and mixing fluid stream and the second fluid mixing stream exit nozzle 10 as a single fluid stream which enters a cup below nozzle 10 to form the final dispensed beverage product.

The mixing fluid stream is divided into two streams so that the amount of mixing fluid within mixing chamber 51 decreases to prevent excessive foaming during its mixing with the beverage syrup. Furthermore, the second mixing fluid stream contacts the outer surface of the mixed beverage syrup and mixing fluid stream so that additional mixing occurs within the cup. That additional mixing eliminates stratification by providing a complete mix between the mixing fluid and beverage syrup. Accordingly, nozzle 10 provides a high volume flow while eliminating both excessive out-gassing from the mixing fluid and stratification between the beverage syrup and mixing fluid.

Although the present invention has been described in terms of the foregoing embodiment, such description has been for exemplary purposes only and, as will be apparent to those of ordinary skill in the art, many alternatives, equivalents, and variations of varying degrees will fall within the scope of the present invention. That scope, accordingly, is not to be limited in any respect by the foregoing description, rather, it is defined only by the claims which follow.

We claim:

1. A beverage dispensing nozzle, comprising:

a housing having an inlet thereto and an outlet therefrom;

a conduit residing within and extending downwardly through and coextensive with the outlet portion of said housing;

a diffuser positioned within said housing to reside on the upper end of said conduit;

a mixing chamber defined by the interior surface of said conduit which communicates with the outlet from said housing;

a passageway within said diffuser which communicates with a beverage syrup source to deliver beverage syrup into said mixing chamber;

a first channel defined by the exterior surface of said diffuser and the interior surface of the top of said housing which communicates with a mixing fluid source via the inlet into said housing to receive a mixing fluid stream;

a diffuser plate positioned within said first channel; and a second channel defined by the exterior surface of said conduit and the interior surface of said housing which communicates with the outlet of said housing, wherein said conduit divides the mixing fluid stream exiting said first channel to deliver a first mixing fluid stream to said mixing chamber and a second mixing fluid stream to said second channel.

2. The beverage dispensing nozzle according to claim 1 wherein said diffuser plate includes a plurality of holes through which the mixing fluid stream flows to create a laminar flow in the mixing fluid stream.

3. The beverage dispensing nozzle according to claim 1 wherein said housing comprises a cap connected to a body.

4. The beverage dispensing nozzle according to claim 1 wherein said diffuser includes at least one fin to separate said diffuser from said conduit.

5. The beverage dispensing nozzle according to claim 1 wherein said conduit includes at least one vane to separate said conduit from said the interior surface of said housing.

* * * * *